United States Patent [19]

Yust

[11] 4,262,962

[45] Apr. 21, 1981

[54] STADIUM SEAT ARM GRIPPING TRAY

[76] Inventor: Paul J. Yust, 4645 N. Kansas, Kansas City, Mo. 64116

[21] Appl. No.: 14,335

[22] Filed: Feb. 23, 1979

[51] Int. Cl.[3] ..... A47C 7/62

[52] U.S. Cl. ..... 297/194; 297/145

[58] Field of Search ..... 297/194, 188, 145, 153, 297/161; 108/26, 25

[56] References Cited

U.S. PATENT DOCUMENTS

| | | | |
|---|---|---|---|
| 994,797 | 6/1911 | Streit | 297/145 X |
| 1,435,774 | 11/1922 | Wilkins | 297/145 |
| 1,789,245 | 1/1931 | McIntyre | 297/145 X |
| 2,617,473 | 11/1952 | Krimstock et al. | 237/161 |
| 2,942,921 | 6/1960 | Rachman et al. | 108/26 |
| 3,586,368 | 6/1971 | Guild | 297/188 X |
| 3,675,969 | 7/1972 | Gage | 297/194 |
| 3,807,319 | 4/1974 | Steanson, Jr. | 297/194 |
| 4,040,659 | 8/1977 | Arnold | 297/194 |
| 4,146,159 | 3/1979 | Hemmen | 295/194 X |

*Primary Examiner*—Roy D. Frazier
*Assistant Examiner*—Peter A. Aschenbrenner
*Attorney, Agent, or Firm*—Thomas M. Scofield

[57] ABSTRACT

A tray adapted to slide on to and grip the arm of a stadium or theater seat; trays which will receive and hold containers of comestibles which are removably applicable to stadium or theater seat arms.

19 Claims, 10 Drawing Figures

Fig. 7.
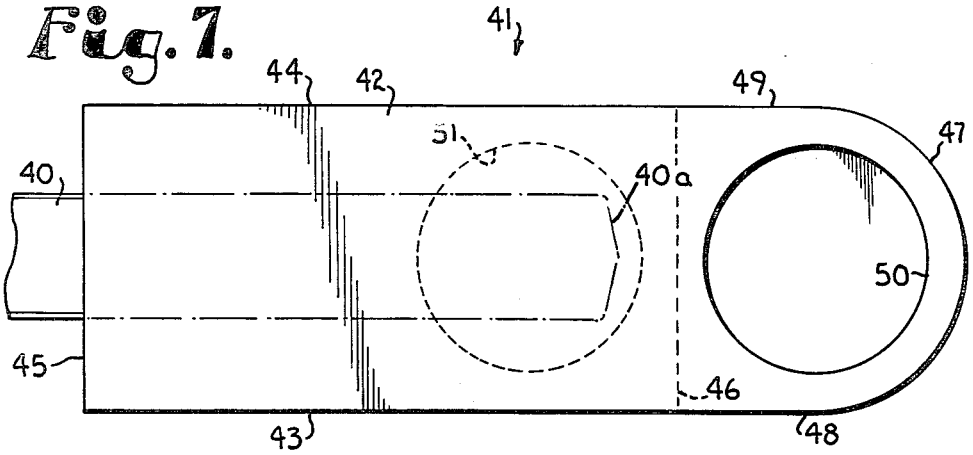
Fig. 8.
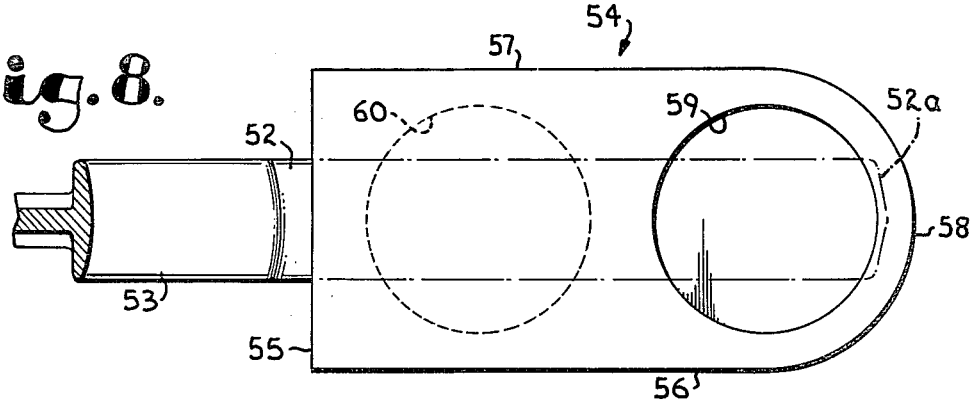
Fig. 10.
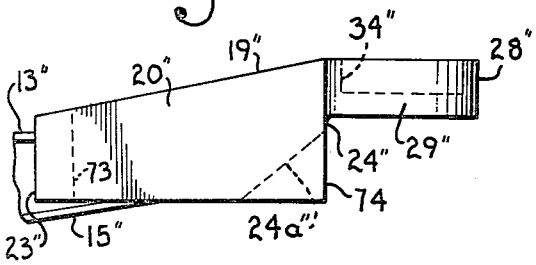
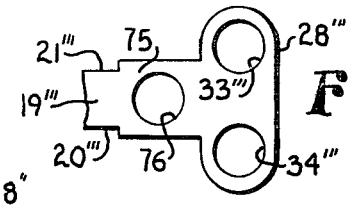
Fig. 11.
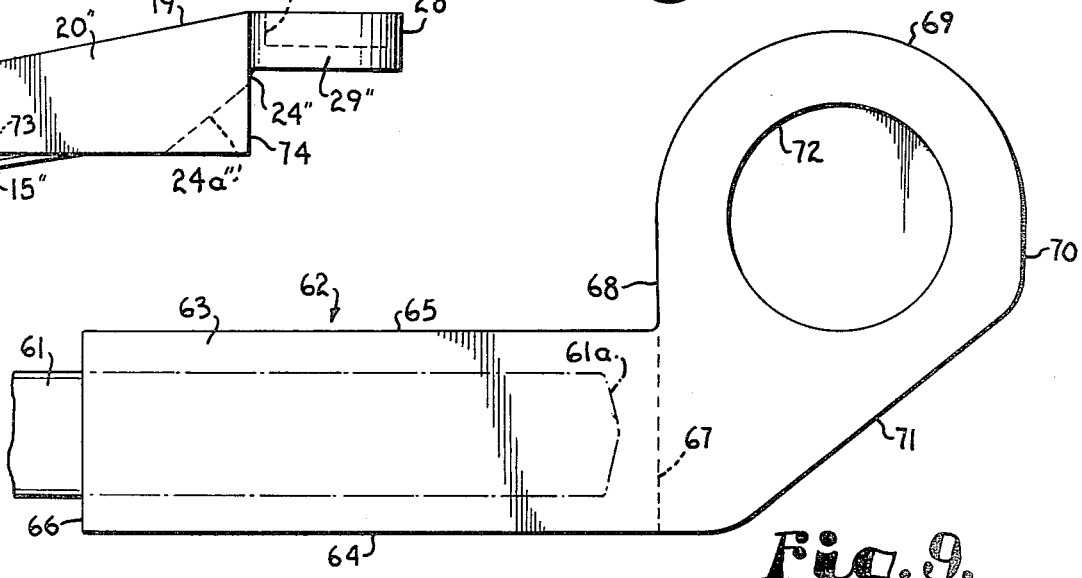
Fig. 9.

STADIUM SEAT ARM GRIPPING TRAY

BACKGROUND OF THE INVENTION

In the crowded baseball, football and basketball stadiums of the present day, tens of thousands of spectators may throng to great sport spectacles. Such events may continue for several hours, typically in the afternoon or evening. Often, for convenience, spectators will arrive and leave from a stadium thirty minutes to an hour or even a larger interval of time before and after the event occurs.

In the course of such sporting events and the spectation thereof, refreshment may be taken several times. In the typically crowded seating conditions, other spectators may move back and forth in front of a spectator in the seating aisle. In addition, the containers of soft drinks, food and beer may be of considerable size and capacity so that there is a problem of stable maintenance of same, not only with respect to traffic back and forth in front of the spectator, but also with respect to his own movement with respect to his seat. This includes rising and sitting down as the action may ebb and flow in the particular event. Because of these stadium conditions, it would be desirable to have available a tray, particularly for containers of beer and soft drink beverages, which tray would be strong and stable, not interfere with traffic in front of the spectator's seat and which would obviate the necessity of carrying the container continuously in the spectator's hand or putting it on the ground where it could be knocked over. At the same time, such device should permit use of the entire seat and its arm for normal sitting, arm rest and the like.

In view of the obvious need for such a device, it is surprising not to find such available in the great stadiums of the present time. The need for such is obviously now and such is the provision of this particular invention.

THE PRIOR ART

I am aware of only two prior art patents directed to supporting devices for drinking glass, drinking containers or the like as follows:

Barrier U.S. Pat. No. 2,879,023 "Drinking Glass Holder" issued Mar. 24, 1959; and Pazzano U.S. Pat. No. 2,995,333 "Drinking-Glass Holder And Mount", issued Aug. 8, 1961.

OBJECTS OF THE INVENTION

A first object of the invention is to provide a combined arm rest and tray for receiving, holding, retaining and supporting a plurality of drinking containers on a conventional stadium seat arm for two persons who occupy adjacent seats.

Another object of the invention is to provide an extremely handy, extremely strong, extremely secure and extremely simple device which solves the problem of providing a food and/or drink tray for adjacent stadium seats without in anyway impairing the action of the seats, the access thereto, the access to and fro in front of same and the use of the arm rest of said seats by the occupants.

Another object of the invention is to provide a novel device which may be transported to and from a sports stadium by one or more spectators, the device comprising a slide-over mount to grip and engage the working portion of a stadium seat arm, there being attached thereto a simple yet rugged tray construction adapted to receive two drinking containers of conventional size for beer, soft drinks or the like. Alternatively, the device may be used to hold peanut packages, popcorn bags or cups or containers of other comestibles.

Still another object of the invention is to provide such a stadium seat arm carried tray and rest, which device may be used and is useful the entire time spent in the stadium or removed from the arm and stored under the seat whenever not in use or not wished to be used by the owners.

Another object of the invention of the subject invention is to provide a supplemental arm rest for the conventional arm rest between two stadium seats which increases the usability and comfort of the arm rest itself for the two adjacent occupants (better permitting each of them to simultaneously use the rest), while additionally providing and presenting a simple, rugged tray to receive, hold and retain drinking containers in such manner as to greatly enhance the pleasure and convenience of the seat holders at a sporting event.

Another object of the invention is to provide such a device of extremely simple construction, great strength, long life, and useful nature, wherein all the parts thereof are always readily available for cleaning or repair.

Another object of the invention is to provide such a stadium seat arm mounted device which not only serves as a supplemental arm rest and tray, but which additionally provides numerous surfaces for application of the indicia of the spectator's favorite teams thereon.

Another object of the invention is to provide such a device which universally may be used on any standard stadium seat arm construction, the device being applied to and removed from the seat at each sporting event and carried to and from the stadium or stadiums by the owner and user.

A further object of the invention is to provide a variety of devices of the type described to fit varying conditions and purposes at particular stadiums or with respect to particular attendance or seating conditions.

Still another object of the invention is to provide such described devices which are adapted to be used in extremely narrow and/or extremely short seating conditions, specifically, that is, where a plurality of containers may be received and held by the device, yet the device not extend laterally any substantial distance over the seats adjacent the arm rest mounting the device and/or wherein the device itself does not extend substantially any distance whatsoever into the aisle in front of the seats.

Yet another object of the invention is to provide devices of the character described wherein more than two drinks or comestible containers may be carried by the device or, alternatively, but a single container be carried by the device with extension in front of and over the seating area of but one person.

Other and further objects of the invention will appear in the course of the following description thereof.

THE DRAWINGS

In the drawings, which form a part of the instant specification and are to read in conjunction therewith, embodiments of the invention are shown and, in the various views, like numerals are employed to indicate like parts.

FIGS. 7 is a plan view of a modified form of the device having a pair of cup receiving openings therein, the device extending somewhat outwardly from the end of the arm of the seat, but not in any way impeding or extending over in front of either seat.

FIG. 8 is a top plan view of a device similar and analogous to that seen in FIG. 8, but wherein the device only overlies the seat arm, per se, not extending substantially outwardly from the end of the arm or over in front of either seat.

FIG. 9 is a plan view, from above, of a modified form of the device where but a single container receiving support is provided for but a single seat and extending laterally only in front of said seat.

FIG. 10 is a side view of a modified form of the device of FIG. 1, but having a down-tapering upper surface for maximum wrist-hand comfort. A dotted line showing illustrates a second modification for a shortened outer arm end engagement.

FIG. 11 is a fragmentary end view of the device of FIG. 1, taken in plan view like FIG. 2, showing a modification of the device to have a third container receiving opening therein adjacent the end of the seat arm engaging portion thereof.

STRUCTURE AND FUNCTION

Figure 3:
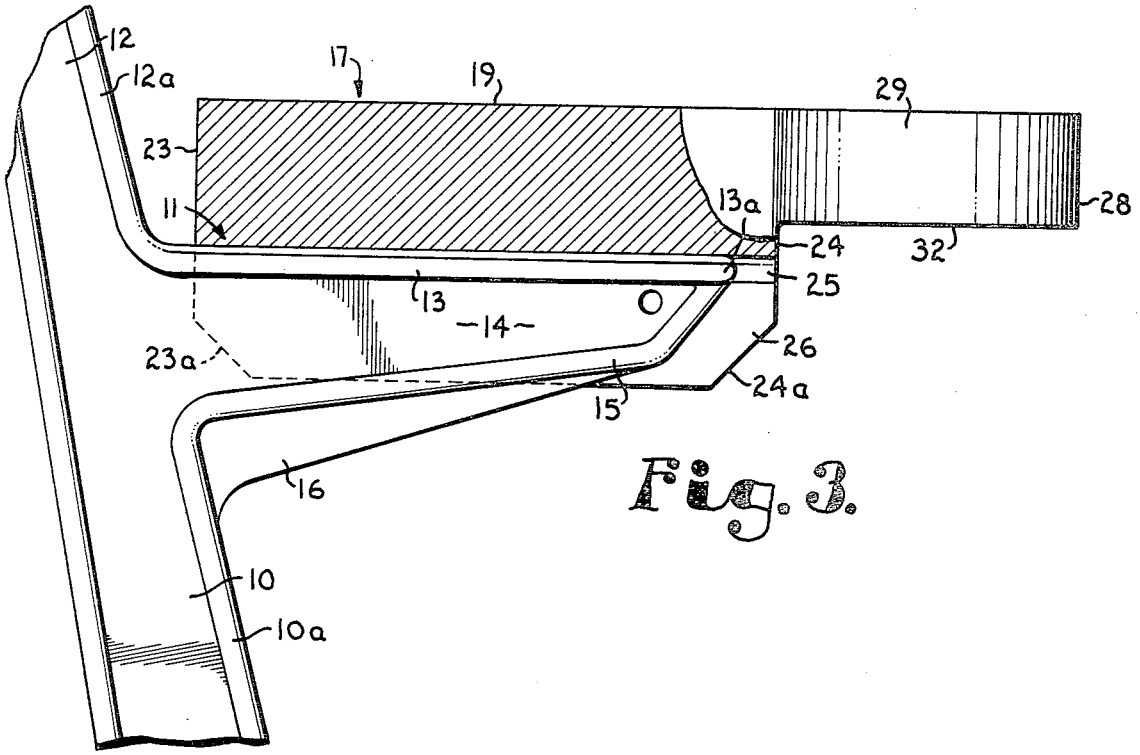
FIG. 3 is a side view of the subject device mounted on a stadium seat arm with a portion of the device cut away to better show the conventional stadium seat arm construction, as well as the internal structure of the engaging portion of the device.
Figure 4:
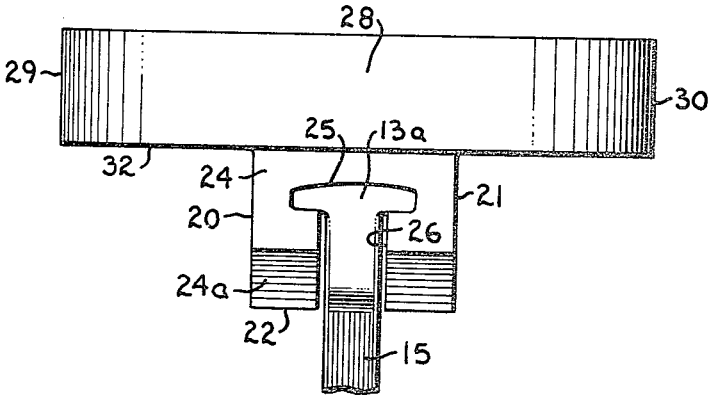
FIG. 4 is an end view of the device, looking at the tray end, the device mounted on the stadium seat arm as in FIG. 3. This is a view taken from the right side of FIG. 3 looking to the left in the view.

Referring particular to FIG. 3, therein is shown a standard side element or member for a stadium seat having a lower portion 10 below the arm portion generally designated 11 and an upper portion 12 thereabove. Typically, lower portion 10 receives (below the part shown) a beam carrying a pivotable seat and seat leg or support construction therebelow. The upper portion 12 typically is engaged or integral with the stadium seat back. However, the detailed structure of the stadium seat, per se, is unimportant for the purposes of this invention. What is critical and typical is the presence of a pair of arms 11 on each side of the seat (only one of which is shown in the various views), one of such arms 11 typically being shared by two adjacent seats. Such an arm 11, as is seen in the various views, typically is of T-cross section. That is, there is a flat or slightly arcuate (on the top) top flange 13 which is normally integral with or continuous with the front flange portion 12*a* of the upper portion 12 of the side seat member. Below the horizontal arm rest portion 13 extends rib or brace portion 14 which like 12 is vertical, thus forming the T-section configuration noted. A flange brace portion 15 typically runs from the outermost (to the right in FIG. 3) extremity 13*a* of rest portion 13 of arm 11 angling downwardly and backwardly to join the front bracing flange 10*a* of the lower portion 10 of the side element. An additional brace member 16 may be provided below ridge or flange 15. Typical dimensions of the various parts, including the subject device in question, will be later given to show relative scale.

At any rate, what is illustrated is the typical, minimal arm rest which provided in a stadium seat of stadiums built in the 1960's and 1970's in the United States, that is, a normally horizontal, flat or slightly arcuate beam or bar member 13 between two seats or at the side (free side) of a stadium seat at the end of a row. This horizontal beam is connected to or integral with the side seat structurals and has an outer free end, an inner end connecting to the seat structure and at least a simple bar brace below, forming in combination therewith a T-section structure.

It should additionally be noted that the seat arm or arm rest upper surface 13 is often positioned on the seat several inches too low for most comfortable use. Accordingly, unless the user of the seat leans strongly to one side, the conventional arm rest is of little use or aid and comfort in seating.

FIGS. 1–5, inclusive show the preferred form of the subject device. Basically conceived, this is made up of two parts or portions. The first of these is an inboard arm or mounting portion generally designated 17. The second of these is an outboard (away from the seat back of the stadium seat) tray portion 18. In this specific modification shown, the base or arm portion 17 has a flat top surface 19, normally horizontal, two normally vertical side faces 20 and 21 and a bottom surface 22. Arm portion 17 may be formed of solid wood, solid plastic, solid light metal (such as aluminum) or any other suitable substance. It may additionally be relieved in portions thereof or hollow for weight saving purposes. The arm portion additionally has inboard or rearmost face 23 and outboard or forward face 24.

There is additionally provided, in the lower portion of member or arm 17 a T-section slot having an upper portion 25 constituting the normally horizontal top bar of the T and lowermost portion 26 constituting the normally vertical lower T bar or leg at right angles to portion 25. This passage, with its configured T-section portions 25 and 26 preferably extends through the entire length (from inboard face 23 to outboard face 24) of member 17. This is clearly seen in FIG. 3. The interior dimensions of portions 25 and 26 of the T section passage way are preferably congruent with the outer dimensions of members 13 and 14 of the seat arm 11, whereby, when the device is slid over the seat arm top surface and underlying brace, there will be a sliding, yet friction fit between the two members, whereby a secure mounting of the device may be obtained on the seat arm.

Forward and rearward faces 24 and 23 may be beveled or relieved as seen at 24*a* and 23*a* to reduce the quantity of material used and to aid in seat portion clearance. The connecting edges of panels 19–23, inclusive may be rounded or beveled as desired, as well.

Figure 1:
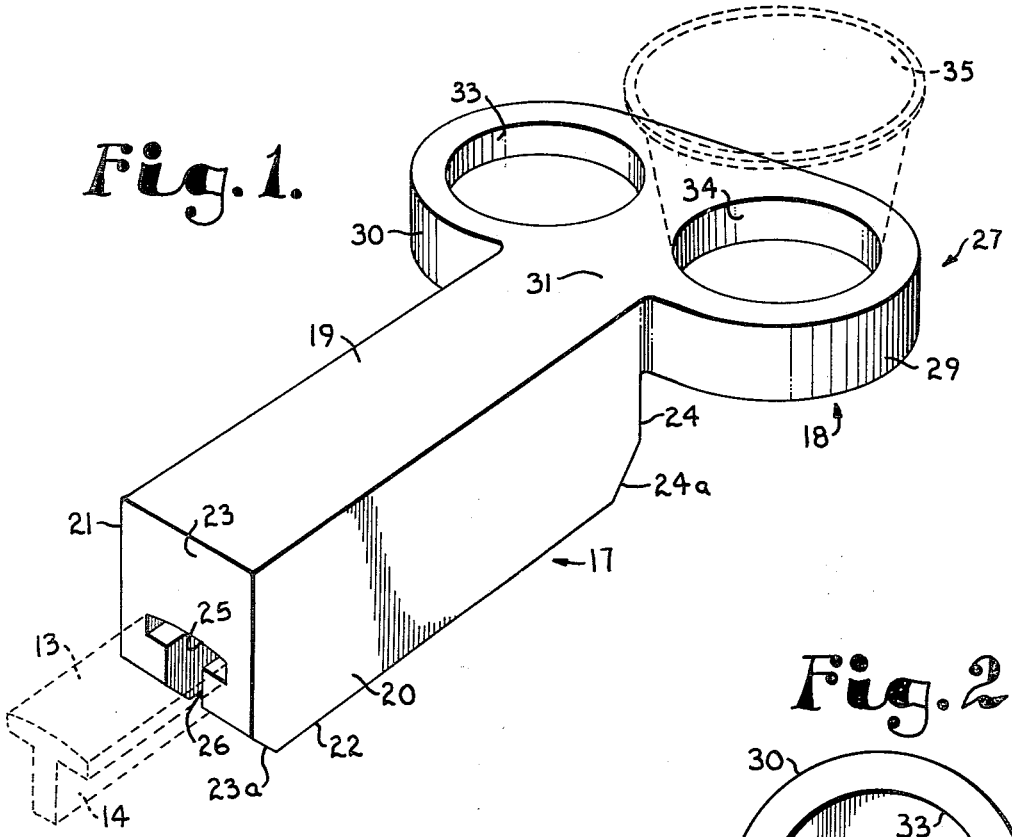
FIG. 1 is a three quarter perspective view from above of the subject device with the stadium seat arm and a drink container ghosted into the view.
Figure 2:
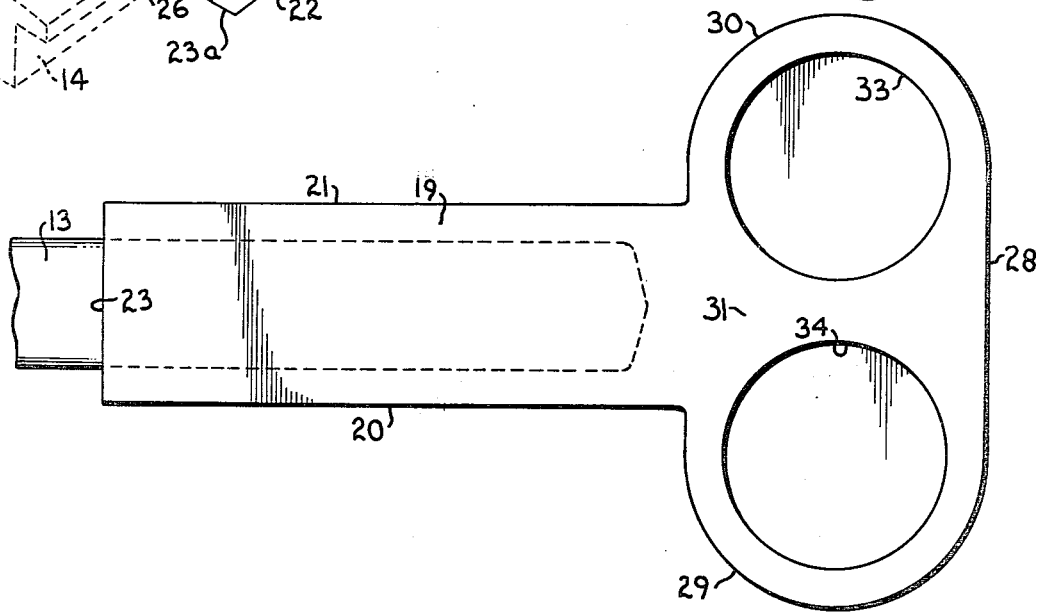
FIG. 2 is a plan view, from above, of the device of FIG. 1.

Secured to the front face 24 of the stadium seat arm gripping member 17 is a tray generally designated 27. This tray may be of any configuration desired, but is, most conveniently and most usefully, that design shown. Specifically, this constitutes a flat block of wood, plastic or metal having a forward edge or face 28, normally vertical, and rounded normally vertical side edges 29 and 30 which merge forwardly into face 28 and rearwardly into member 17. Tray 22 has top flat surface 31, preferably continuous and level with face 19 of member 17 and an undersurface or wall 32. A pair of round (preferably but not necessarily so) recesses 33 and 34 of fairly substantial depth are symmetrically placed in the body of the tray. These two container receiving recesses are sufficiently spaced from one another that the conventional soft drink and beer cups dispensed in stadia over the country will conveniently and securely fit thereinto with their bases. Such a cup is seen in FIG. 1 at 35.

It is important that the following characteristics be present with respect to the tray:

(1) It should not be of such width as to prevent the occupant of either seat on side of arm 11 from getting into and out of the seat;

(2) It should be of sufficient width to hold at least two conventional sized drinking cups, as mentioned;

(3) It should be of sufficient depth that the cups will be securely received therewithin;

(4) The depth of tray 27 cannot be (if its top surface is to be aligned with surface 19) greater than the height of face 24 above slot portion 25; and (5) The extension of tray 27 forwardly should not block the aisle in front of the two seats.

In point of fact, particularly with respect to the last noted issue, typically, the seat arm 11 will be of considerably less forward extension than the pivotable seats themselves. Accordingly, with the front portion of the arm member 17 extending just past the end of flange 13 at 13*a*, generally the tray will not extend much past the actual forward edges of the seats, particularly with the knees of the occupants also extending therepast. Thus it can be seen that this entire device fits well within the scope and dimensions of a conventional stadium seat. Additionally, when mounted on the seat arm 11 portion 13, the upper surface thereof provides not only a higher level arm rest, but a broader such. Yet further, when no cups are present, or only one such, the forward portion of the device may be used as a hand rest, as well. Thus it is a supplemental and comfort giving arm rest, per se, in addition to being a tray and receptacle.

In use and operation, all the owner needs to do is carry the device to the stadium and slide it onto and off of the stadium seat arm, for use and removal. The most common stadium spectator attendance is for two or more persons, such as husband and wife, dating couples, friends or the like to attend the stadium with adjacent seats. This device provides an arm rest of great security and comfort and, as well, a convenient, safe, secure and strong tray for soft drinks and other comestibles during the game.

Figure 6:
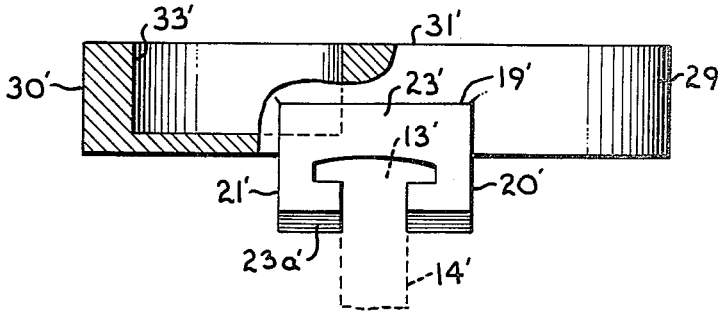
FIG. 6 is an end view like that of FIG. 5, but showing a modified form of the device with (a) a deeper cup impression in the tray portion and (b) a reduction in thickness of the stadium seat arm engaging portion both above and below the actual engagement.

FIG. 6 shows a modified form of the device with a minimal dimension seat engaging arm portion, without regard to the desirable plane surface of the tray and arm rest. In this view, parts the same or similar to parts seen in the previous views are numbered the same, but primed. They will not be again described, where the same. Also in this view, paired openings of greater depth are shown in the device for receiving cups, popcorn bags, popcorn cups, packages of candy or the like. This is one configuration of the device which would be employed where minimum materials in the construction thereof would be employed, wood, plastic, metal or any combination of the same.

FIG. 7

Referring to FIG. 7, as previously noted, this is a plan view of the modified form of the device having a pair of cup receiving openings therein. While this device extends somewhat outwardly from the end of the seat arm which it engages, it does not in any way extend in front of or impede either seat which is served by the device. This form of the invention is particularly adapted to extremely cramped stadium seating conditions. It has the disadvantage of having the container receiving or carrying portions of the device directly in line with the seat arm, one of them, indeed, being actually over the end of the seat arm. This reduces the usability, to a certain extent, of the seat arm per se. When one container, only, is being used, however, the device is not objectionable with respect to seat arm utilization.

The entire engaging (seat arm engaging) construction of the device of FIG. 7 is assumed to be the same as that seen in FIGS. 1–5, inclusive. Accordingly, this will not be described in detail. The seat arm itself is also assumed to be the construction seen and described with respect to FIGS. 1–5, inclusive and again itself will not be redescribed.

The device itself comprises, in vertical plan view as seen in FIG. 7, an elongate, substantially rectangular member generally designated 41. It has upper surface 42 which is an unbroken plane the entire length of the device, save for the container receiving openings to be described. Bounding upper surface 42 are side faces 43 and 44 which are the equivalent of walls 20 and 21 of the device of FIGS. 1–5, inclusive. The rear or inboard end 45 is normally vertical analogous to end 23 of FIGS. 1–5, inclusive. The basic structure of the seat arm engaging portion from inboard end or wall 45 up to outboard lower wall 46 is of the same structure of the device of FIGS. 1–5 between walls 23 and 24.

The outboard extension or forward end of member 41 has a rounded forward or outboard end 47, as well as parallel side walls 48 and 49 which are continuous with walls 43 and 44, at least in the upper portions of the latter. The outboard end past wall 46 is of lesser thickness than the inboard portion of member 41, as is the case in the device of FIGS. 1–5, inclusive. A side view of this device is not shown, but it would be similar in outline to the side view of FIG. 3.

A first outboard cup or container receiving recess 50 is received in the lesser thickness outboard portion member 41 outboard of wall 46 and a second cup receiving recess (or container receiving recess) 51 is received in the outboard or outer part of the inboard greater thickness portion of member 41. These openings are preferably of substantially the same size and depth as openings 33 and 34 with respect to the device of FIGS. 1–5, inclusive.

The entire purpose of the device of FIG. 7 is to provide a two recess arm engaging device of the character of the device of FIGS. 1–5, inclusive, but wherein there is no lateral extension of the cup holding portion thereof over the seats. This is achieved by the device of FIG. 7, at the cost of loosing some of the operability or usability of the seat arm overlying portion as an arm rest when a container is in opening 51. However, this device is quite usable where the seating is cramped with respect to width and there might be difficulty getting in or out of the seats of adjacent seats where the device of FIGS. 1–5, inclusive is used.

FIG. 8

In FIG. 8, we see the logical extension of the device of FIG. 7. In this view, the horizontal seat arm flange 52 has an outboard end 52*a*. The upwardly and rearwardly slanting seat brace flange 53 is analogous to flange 12*a* of FIG. 3.

The purpose in this case is to provide a one or two opening or recess arm engaging device yet wherein there is a minimum extension past the end of the seat arm and a minimum lateral extension in front of the seats. Such a device configuration might be required by a stadium management in the case of particular seating space problems or the like (or merely to insure absolutely no interference with seat traffic).

In any case, the unit is generally designated 54, having a rear face 55, side faces 56 and 57 and a rounded end face 58. In this case, the configuration of the device itself is like the configuration of the device of FIGS. 1–5, inclusive from wall 23 up to wall 24, with the front wall rounded off. In such case, two openings, here 59 and 60, are provided in the surface overlying the seat arm. It is evident that the device cannot be used as an arm rest, even partially, when both openings would be filled by containers.

Figure 5:
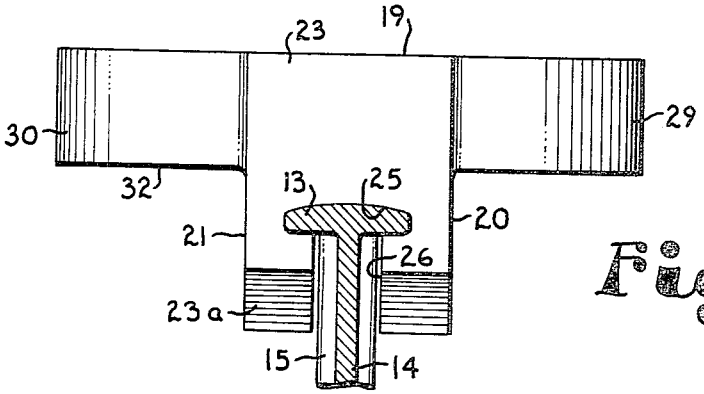
FIG. 5 is an end view of the device of the previous figures analogous to the view of FIG. 4, but taken from the opposite end of the device. The view is sectional through the stadium seat arm and is taken from the left hand portion of FIG. 3 looking to the right in the view.

In end view, from the inboard end of wall 55, such end view would be like the view of FIG. 5, but without the laterally extending portions 29 and 30 of FIG. 5. The front view of the device of FIG. 8 would be a view like that of FIG. 4, but with the front end rounded off. A sectional view through the device would be like that of FIG. 3 up to wall 24 with, additionally, the openings provided in the body of the device over the seat arm.

FIG. 9

In the view of FIG. 9, we see a seat arm having top flange 61 and outboard end 61*a*. The device itself is generally designated 62, having an inboard portion with top face 63, side walls 64 and 65 and rear or inboard wall 66. The front end of the inboard portion is defined by wall 67 which is the same as wall 24 in the device of FIGS. 1–5, inclusive. All of the characteristics of the inboard portion of the device of FIGS. 1–5, inclusive may be identical with respect to the inboard portion of the device of FIG. 9. That is, the structure of the device of FIGS. 1–5, inclusive between walls 23 and 24 is the same as the structure of the FIG. 9 device between walls 66 and 67. Alternatively, the inboard portion of the device of FIG. 9 may be the same configuration as the inboard portion of the device of FIG. 6 (lesser thickness).

The outboard portion of the device of FIG. 9 is that portion which differs substantially from the device of FIGS. 1–5, inclusive. Specifically, the tray portion of the device of FIG. 9 is one half of the tray portion of the device of FIGS. 1–5, inclusive with the center portion of the tray cut away to minimize material and free the space outside of the device as much as possible. Thus, the outboard tray portion of FIG. 9 has an inboard wall 68, a rounded side wall 69, an outboard wall 70 parallel to wall 68 and an angled side wall 71. The thickness of this portion of the device of FIG. 9 is the same relative thickness as the tray portion of FIGS. 1–5, inclusive is to the inboard portion of the device of FIGS. 1–5, inclusive or FIG. 6. Container receiving opening or recess 72 is provided therein.

FIG. 10

Referring to FIG. 10, this device is substantially the same as the device of FIGS. 1–5, inclusive, with respect to all elements of structure, save for two below noted variations. Accordingly, corresponding parts of the device to the parts seen in FIGS. 1–5, inclusive are numbered the same, but double primed. These will not be redescribed.

The first difference which may be incorporated in the device of FIGS. 1–5, inclusive (which is illustrated in FIG. 10) is a downwardly tapering upper surface 19″. Under certain circumstances, this may make for a more comfortable arm rest, as well as reducing weight. The downward incline is from outboard to inboard.

The second modification shown is the optional cutoff at the dotted line 73, making a shorter and lighter device. In such case, the front face or end 24″ (at 74) may not be beveled off and, in any case, will be solid so as to block the arm engaging passage to prevent the device sliding too far inboard on the seat arm. When the shorter device is employed, the inclined upper face 19″ is preferably used in order to avoid having a sharply upwardly extending face positioned intermediate the ends of the seat arm, which would be uncomfortable in use.

FIG. 11

This device is identical to the device of FIGS. 1–5, inclusive, save for one difference, specifically, the outboard end of the basic arm engaging portion of the device is increased in width in order that a third container or package receiving recess may be provided in the device inboard of the tray portion. Accordingly, all of the parts of the device common to the structure of FIGS. 1–5, inclusive are numbered the same, but triple primed and will not be redescribed. The widened portion of the engaging portion of the device is generally designated 75 and has third recess or opening 76 therewithin. This opening may be of the same or different size and shape with respect to openings 33‴ and 34‴.

TYPICAL DIMENSIONS

Typical dimensions of the device and the stadium seat elements with which it is associated will now be given. These are intended to be illustrative and not limiting.

The length of the seat arm portion 13 is eight and one half inches. The distance between Flange 15 and top portion 13 of the arm varies from something less than an inch to two inches, moving from the outboard portion of arm 13 inward toward beam elements 12 and 10. The typical width of the top portion of the seat arm (13) is one and one half inches. The width of flanges 15 and 10*a* are approximately three quarters of an inch. The web 14 is slightly greater than an eighth of an inch in thickness.

Turning to the particular device, the length thereof, from face 23 and face 28, is substantially 12 inches. The width of face 19 is two and a half inches. The length of member 17 is eight inches. The depth of arm portion 17 (height of face 20) is three and a half inches. The height of the tray portion (face 28) is one and a half inches. The depth of the cup recesses 33 and 34 is three quarters of an inch. The width of the T leg slot 26 in members 17 is slightly over three quarters of an inch. The height of the T slot in member 17 from face 22 is one and three quarters inches. The width of the T slot portion in member 17 at 25 is approximately one and three quarters inches.

The depth of flange 13 on the arm is slightly over an eighth of an inch and the height of the horizontal bar of the T slot at 25 is slightly greater than this.

If the dimensions of the seat arms vary, the dimensions of the engaging portions of the device must conform. The dimensions of the various portions of the device, per se, may be varied additionally with respect to the materials used.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown is the accompanying drawings is to be interpreted as illustrative and not in a limiting sense.

I claim:

1. A tray device for use in association with one arm of a stadium seat, which seat has at least one substantially horizontal arm portion extending along at least a portion of one side thereof, such seat arm being of substantial T-shape cross section in the said horizontal portion thereof, said tray device comprising, in combination:

an elongate beam member of substantially rectangular cross-sectional configuration having inner and outer ends thereof, said beam member of a length equal to a substantial portion of the length of the horizontal portion of the arm of said stadium seat, as well as width and depth each greater than said seat arm, a T-section passage formed in the lower portion of said beam member and extending therethrough lengthwise from the inner end thereof a distance at least substantially equal to the length of the horizontal portion of said arm, said passage configured so as to slidingly receive the horizontal portion of said stadium seat arm in the length thereof in friction fitting fashion, a tray member fixed to the outer end of said beam member past the seat arm engaging portion thereof, the top surface of the beam member and the tray member being both substantially horizontal and in line with one another so as to provide a continuous, substantially horizontal resting surface of greater width and length than the seat arm for the user's arm, the tray member being of lesser depth than the beam member whereby the tray is positioned above the top surface of the seat arm, and the tray member having at least one recessed portion therein for the receipt of a container.

2. A device as in claim 1 wherein the tray member is of greater width than the base member, is symmetrically placed at the end of the latter and has at least two recessed portions therein to receive containers in secure fashion.

3. A device as in claim 1 wherein the length of the base member is greater than that of the horizontal portion of the stadium seat arm.

4. A device as in claim 1 wherein said T-section passage in the lower portion of said beam member extends through the entire length of said beam member.

5. A device as in claim 1 wherein the tray member and said beam member are of substantially the width in vertical plan view, and but a single container receiving recess is provided in said tray member.

6. A device as in claim 5 including a second container receiving recess provided in the top surface of said beam member adjacent said tray member.

7. A device as in claim 1 wherein the tray is of greater width than the base member, is symmetrically placed at the end thereof and has at least two recessed portions therein to receive containers in secure fashion, the outboard portion of the beam member, adjacent the tray member, being sufficiently wide to receive and having therein a third recess to receive a container therein in secure fashion.

8. A device as in claim 1 wherein the tray member extends both outwardly from and laterally of the beam member on one side thereof and has but a single recess therein to receive a container in secure fashion.

9. A device as in claim 1 wherein the top surface of the beam member inboard of the tray member slopes slightly downwardly away from the tray member towards the inboard end of the seat arm.

10. A device as in claim 1 wherein said T-section passage in the lower portion of said beam member ends short of the outboard end thereof whereby to limit the inboard placement of said tray device on the seat arm.

11. A tray device for use in association with one arm of a stadium seat, which seat has at least one substantially horizontal arm portion extending along at least a portion of one side thereof, such seat arm being of substantial T-shape cross-section in the said horizontal portion thereof, said tray device comprising, in combination:

an elongate beam member of substantially rectangular cross-sectional configuration having inner and outer ends thereof, as well as upper and lower substantially horizontal surfaces and substantially vertical side edges, said beam member adapted to overlie the substantial entire upper surface of said stadium seat arm horizontal portion and rest thereon, being of a width greater than said arm and a length at least substantially equal thereto, said beam member having two downwardly extending and inwardly opposed J-section members, one positioned at each side of the beam member, and connected at their upper ends to the side edges of said beam member, said J-members so configured as to, in cooperation with the underside of the beam member, slidingly engage, in friction fitting fashion, the said T-section horizontal portion of the seat arm in at least a portion of its length, a tray member fixed to the outer end of said beam member and past the said horizontal portion of said seat arm, once said tray device is fully engaged with said seat arm horizontal portion, the top surface of the beam member and the tray member being both substantially horizontal and in line with one another so as to provide a continuous, substantially horizontal resting surface of greater width and length than the seat arm horizontal portion for the user's arm, the tray member being of a depth no greater than the beam member, whereby the tray is positioned above the top surface of the seat arm horizontal portion, and the tray member having at least one recessed portion therein for the receipt of a container.

12. A device as in claim 11 wherein the tray member and the beam member are substantially the same width in vertical plan view, and but a single container receiving recess is provided in said tray member.

13. A device as in claim 12 including a second container receiving recess provided in the top surface of said beam member adjacent said tray member.

14. A device as in claim 11 wherein the tray member is of greater width than the base member, symmetrically placed at the end of the latter and has at least two recessed portions therein to receive containers in secure fashion.

15. A device as in claim 14 wherein the outboard portion of the beam member, adjacent the tray member, is sufficiently wide to receive and has therein a tray recessed to receive a container therein in secure fashion.

16. A device as in claim 11 wherein the tray member extends both outwardly from and laterally of the beam member on one side thereof and has but a single recess therein to receive a container in secure fashion.

17. A device as in claim 11 wherein the top surface of the beam member, inboard of the tray member, slopes slightly downwardly away from the tray member toward the inboard end of the seat arm.

18. A tray device for use in association with one arm of a stadium seat, which seat has at least one substantially horizontal arm portion extending along at least a portion of one side thereof, such seat arm being of substantial T-shape cross section in the said horizontal portion thereof, said tray device comprising, in combination:

an elongate beam member of substantially rectangular cross-sectional configuration having inner and outer ends thereof, said beam member of a length equal to a substantial portion of the length of the horizontal portion of the arm of said stadium seat, as well as width and depth each greater than said seat arm, a T-section passage formed in the lower portion of said beam member and extending therethrough lengthwise from the inner end thereof a distance at least substantially equal to the length of the horizontal portion of said arm, said passage configured so as to slidingly receive the horizontal portion of said stadium seat arm and the length thereof in friction fitting fashion, a tray member fixed to the outer end of said beam member past the seat arm engaging portion thereof, the top surface of the beam member and the tray member each being substantially horizontal but out of line with one another, the top surface of the beam member being lower than the top surface of the tray member, so as to provide a continuous, substantially horizontal elevated resting surface for the user's forearm inboard of the tray member with the tray member providing an elevated handrest therewith, the tray member being of lesser depth than the beam member whereby the tray is positioned above the top surface of the seat arm, and the tray member having at least one recessed portion therein for the receipt of a container.

19. A tray device for use in association with one arm of a stadium seat, which seat has at least one substantially horizontal arm portion extending along at least a portion of one side thereof, such seat arm being of substantial T-shape cross section in the said horizontal portion thereof, said tray device comprising, in combination:

an elongate beam member of substantially rectangular cross-sectional configuration having inner and outer ends thereof, as well as upper and lower substantially horizontal surfaces and substantially vertical side edges, said beam member adapted to overlie the substantial and entire upper surface of said stadium seat arm horizontal portion and rest thereon, being of a width greater than said arm and a length at least equal thereto, said beam member having two downwardly extending and inwardly opposed J-section members, one positioned at each side of the beam member and connected at their upper ends to the side edges of said beam member, said J-members so configured as to, in cooperation with the underside of the beam member, slidingly engage, in friction fitting fashion, the said T-section horizontal portion of the seat arm in at least a portion of its length, the top surface of the beam member being substantially horizontal so as to provide a continuous, substantial horizontal resting surface of greater width and length than the seat arm horizontal portion for the user's arm, and the beam member having at least one recessed portion therein adjacent the outboard end thereof for the receipt of a container.

* * * * *